US007121478B1

(12) United States Patent
Jones

(10) Patent No.: US 7,121,478 B1
(45) **Date of Patent: *Oct. 17, 2006**

(54) SIDE INGRESS HEIGHT ADJUSTABLE RISER FOR A SPRINKLER

(75) Inventor: Steve Jones, Newbury Park, CA (US)

(73) Assignees: Steven R. Jones, Palm Springs, CA (US); Diane M. Jones, Palm Springs, CA (US), Family Trust UTD Dec. 23, 2003

( * ) Notice: Subject to any disclaimer, the term of this patent is extended or adjusted under 35 U.S.C. 154(b) by 33 days.

This patent is subject to a terminal disclaimer.

(21) Appl. No.: 10/844,119

(22) Filed: May 13, 2004

Related U.S. Application Data

(60) Provisional application No. 60/506,489, filed on Sep. 29, 2003.

(51) Int. Cl.
*B05B 15/10* (2006.01)

(52) U.S. Cl. ..... 239/203; 239/200; 239/201

(58) Field of Classification Search ..... 239/200–206
See application file for complete search history.

(56) References Cited

U.S. PATENT DOCUMENTS 1,790,358 A * 1/1931 Tyrrell ..... 239/204
1,833,040 A * 11/1931 Rader ..... 285/302
3,317,144 A * 5/1967 Muschett ..... 239/204
3,921,911 A * 11/1975 Sheets ..... 239/206
4,272,023 A * 6/1981 Georgiev et al. ..... 239/204
6,050,500 A * 4/2000 Ensworth ..... 239/203
6,629,648 B1 * 10/2003 Jones ..... 239/203

* cited by examiner

*Primary Examiner*—Eric Keasel
*Assistant Examiner*—Jason Boeckmann

(57) ABSTRACT

A side ingress water supply conduit arrangement for use with a height adjustable riser for a sprinkler head that reduces labor required for installation of the water supply conduit. The housing of a height adjustable riser is modified to include an integrally molded conduit, which delivers pressurized water to the bottom of an adjustable riser housing by introducing the water supply to the housing via the side of the housing. This allows the conduit to be located closer to the surface of the ground by installing conduits in a shallow burial location slightly below the top of the riser housing. Therefore, less earth removal and replacement is required, which reduces the labor necessary to install a sprinkler system. Another embodiment creates a modified conduit or tube shape, such as a "J" that works with the individual components of the adjustable riser as disclosed in my U.S. Pat. No. 6,629,648.

14 Claims, 2 Drawing Sheets

SIDE INGRESS HEIGHT ADJUSTABLE RISER FOR A SPRINKLER

Priority claimed based on Ser. No. 60/506,489 filed Sep. 29, 2003 pending.

BACKGROUND OF THE INVENTION

1. Field of the Invention

The present invention relates to the field of irrigation sprinkler systems, and more particularly to a water supply line laterally coupled to an adjustable riser included in an irrigation sprinkler arrangement and which permits the water supply conduit to be located in close proximity to the surface of the ground.

2. Brief Description of the Prior Art

In the past, conventional irrigation sprinkler systems have been employed wherein a plurality of individual irrigation sprinkler heads or units are connected with a water supply line in order to provide irrigation water to a selected terrain area. The supply line is often buried underground and is coupled by various joints and extending risers to the individual sprinkler unit or head. The length of the risers are individually chosen to achieve partial or full exposure of the individual sprinkler unit at a selected height relative to the ground level in accordance with the buried depth of the supply line, as well as the type and height of the specific surrounding vegetation. Usually the housing for the risers are elongated and are installed in the ground in a vertical orientation with the water supply line or conduit attached to the bottom of the housing. Therefore, the water supply line is buried deep enough to connect with the bottom of the riser housing which often requires that the lines or conduits be installed in a deeply dug trench. Since conventional risers are of different lengths, the digging of trenches are burying of water supply lines or conduits is a tedious and labor intensive procedure.

Therefore, a long-standing need has existed to provide a simplified installation procedure and maintenance thereof for irrigation systems which permits the water supply lines to be installed near the surface of the ground so that deep trenches and deep burial of the water supply line is unnecessary. The installation of risers should include a portion of the water supply line or conduit which permits the line or conduit to be located closer to the surface of the ground. A typical adjustable height riser is disclosed in my U.S. Pat. No. 6,629,648 which is suitable for practice of the present invention and the disclosure therein is incorporated into the present Application by reference.

SUMMARY OF THE INVENTION

Accordingly, the above problems and difficulties are avoided by the present invention which provides a side ingress water supply conduit arrangement for use with a height adjustable riser for a sprinkler head which substantially reduces labor required for installation of the water supply conduit. The labor reduction requirement is achieved by modifying the housing of the height adjustable riser to include an integrally molded line or conduit which laterally delivers a pressurized fluid, such as water, to the bottom of an adjustable riser housing assembly. By laterally introducing the pressurized water supply delivery and entry to the housing from the side of the housing, the supply conduit is located closer to the surface of the ground. The conduit is installed in a shallow burial location slightly below the top of the riser housing. By locating the conduit in a shallow location, less earth removal and replacement is required, which reduces the labor necessary to install a sprinkler system. Another embodiment of the present invention creates a modified conduit or tube shape, such as a "J" that works with the individual components of the adjustable riser as disclosed in my issued U.S. Pat. No. 6,629,648 referenced herein.

Therefore, it is among the primary objects of the present invention to provide a lateral water supply conduit arrangement for a height adjustable riser employed in a sprinkler device that permits closer location of the supply conduits to the surface of the ground, wherein such conduits are lateral to the longitudinal axis of the housing for the height adjustable riser.

Another object of the invention resides in providing a side or lateral ingress height adjustment riser for a sprinkler system which reduces the labor required for installation and which is achieved by providing the water supply system integral with the riser housing whereby an integrally molded unit is produced for laterally delivering fluid or water to the underside or bottom of the adjustable riser housing.

Yet another object of the present invention is to provide a fluid delivery and entry conduit arrangement integrally attached to the side of an adjustable riser housing so that the delivery and entry arrangement is slightly below the top of the riser housing which permits the delivery and entry conduits to be located closer to the surface of the ground.

Still a further object of the present invention is to provide a water supply conduit arrangement which requires less earth removal and replacement and reduces the labor necessary to install a sprinkler system.

Still a further object of the present invention is to provide a water supply conduit system which includes compressible or expandable tubing which may or may not include a "T" shaped conduit so as to provide expansion joints for minimizing conduit damage in climates that experience periodic soil freezing.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
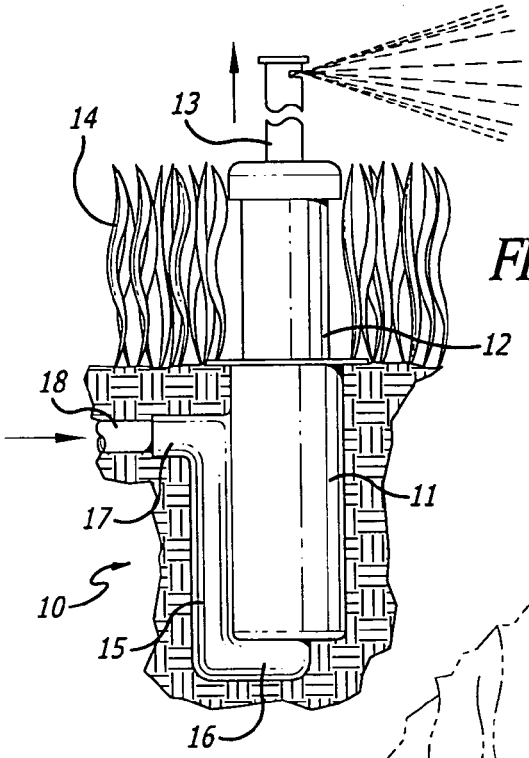
FIG. 1 is a side elevational view of a height adjustable riser for a sprinkler device including a lateral water supply conduit or line in accordance with the present invention.

Referring to FIG. 1, the novel side ingress height adjustable riser for a sprinkler device is indicated in the general direction of arrow 10 which includes a housing 11 having an adjustable riser 12 movably carried by the housing 11 so that the riser may be elevated to a desired position. As illustrated, the adjustable position of the adjustable riser 12 is so that the sprinkler device 13 may be elevated above the height of foliage and such foliage is indicated in general by numeral 14. It is of importance to note that a water supply line or conduit 15 is illustrated having a central body terminating at right angles with an output section 16 that is directly and integrally coupled with housing 11. An input segment 17 is connected to a main water supply pipe 18. It is to be particularly noted that because of the conduit 15, the main water line 18 can be installed close to the surface of the ground and does not require extensive digging or burial.

Figure 2:
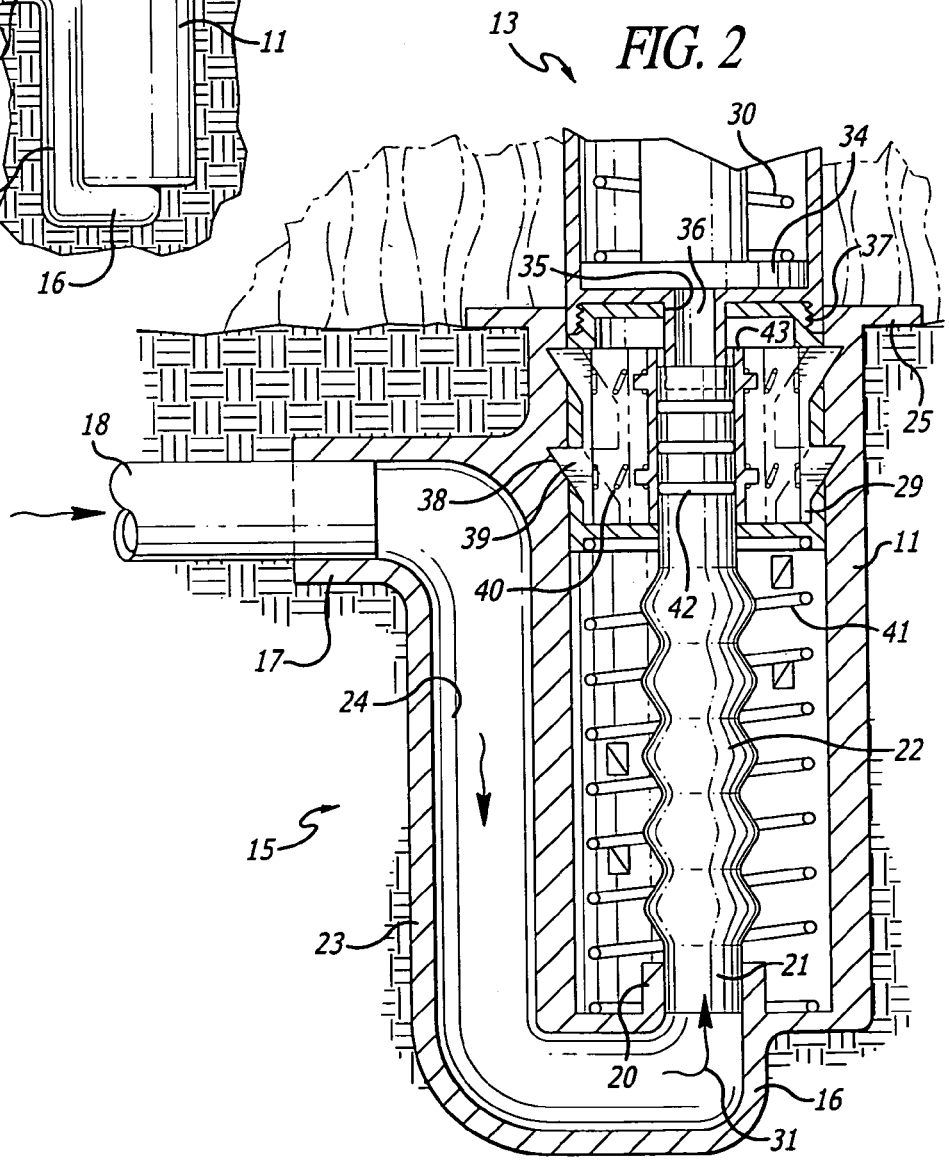
FIG. 2 is an enlarged, longitudinal cross-sectional view of the lateral or side ingress height adjustable riser shown in FIG. 1.

Referring now to FIG. 2, it can be seen that the housing 11 is integrally formed with the water supply conduit 15, wherein the section or segment 16 is integrally formed with the cylindrical wall of the housing at the bottom thereof. The section 16 includes a collar 20 for securement with the end 21 of an extendable or compressible pipe 22. The opposite end of the section 16 is coupled to the input section 17 by an elongated body 23 integral with the housing and defining passageway 24. It is to be particularly noted that the housing 11 is of unitary construction with the conduit 15 defining an open-ended passageway indicated by numeral 24. The opposite ends of the passageways are connected to the compressible/expandable pipe 22 at one end and the water supply line 18 at its opposite end. The top of the housing 11 includes a flange 25 which rests on the surface of the ground. Therefore, it can be seen that a pressurized water supply can be introduced through water supply line 18 in the direction of the arrow so that the pressurized water is conducted through the passageway 24 into the pope 22. The supply of fluid or water through the passageway is determined by valve means (not shown) attached to line 18.

Referring further to FIG. 2, it can be seen that the sprinkler device 13 can be elevated against the expansion of a coil spring 30 when pressurized water is supplied from a water source in the direction of arrow 31. The sprinkler unit 10 is coupled to the water supply by the hose or conduit 18 and passageway 24 which introduces the pressurized water through the variable length hose 22 to impinge against an impact plate 34 carried on the lower end of the tube supporting the sprinkler device 13. As part of the pressurized water supply, it is noted that the pressurized water passes through a cartridge 29 via a coupler piece 35 which includes communication with a passageway 36 terminating at the underside of the impact plate 34. Therefore, pressurized water introduced from the conduit is forwarded through the expansion hose or pipe 22 and the passageway 36 to the underside of the impact plate so that the pressure forcibly urges the sprinkler nozzle upwardly. The upward positioning of the sprinkler device 13 is against the expansion pressure of the spring 30. Therefore, when the pressurized water is reduced, or shut-off, the compressed spring 30 will expand outwardly between the cap (not shown) and the impact plate 34 causing the sprinkler nozzle to retreat through the cap to the storage position or non-operative position, as shown in solid lines.

Referring further in detail to FIG. 2, it can be seen that the cartridge 29 is threadably connected to the adjustable riser 12 by threads 37 so that a unitary construction is provided. Also, it is noted that the inside wall surface of the body 11 includes a plurality of notches, such as notch 38, into which catches, such as catch 39, is normally biased by means of an expansion spring 40. As illustrated, at least four catches are shown and are carried on the cartridge 29 within an internal cavity thereof. Outward movement of the catches in response to expansion of the spring 40 is restricted when the catches engage their inner wall surface of the housing 11, as shown in broken lines. Also, penetration of the catches within the notches will limit the outward expansion movement of the catches. Spring 41 bears against the underside of the cartridge and normally, forcibly urges the cartridge upwardly and the upward movement is limited only by engagement of the catches with the notches, as previously described. Notches can be placed along the inside surface of the bore of housing 11 and additional notches at a lower level are not shown engaged by catches. It can also be seen that O-rings 42 installed on the coupling and bear against an open-ended bore carried at the center of the cartridge 29. The open-ended bore is illustrated by numeral 43. Each catch includes an angular under-surface slidably engageable with a sloping ramp in the notch. Further disclosure of the riser is indicated by U.S. Pat. No. 6,629,648, as noted above.

Therefore, in view of the foregoing, it can be seen that water supplied under pressure to the impact plate 34 will cause the sprinkler head or nozzle to rise to an extended position. When the supply line is turned off or reduced, the expansion of the compressed spring will cause the sprinkler head to retract into the sprinkler device. When it is desired to raise or lower the adjustable riser unit, the user only need to push down slightly and twist or rotate the adjustable riser unit in order to disconnect the catches from the notches. The catches are urged against their expansion spring and the cartridge can be moved upwardly or downwardly accordingly. When it is desired to set the sprinkler nozzle at a certain elevation, the user twists or turns the adjustable riser unit assembly until the catches match a desired level of notches. Various levels are illustrated by numerals 70–73.

Figure 3:
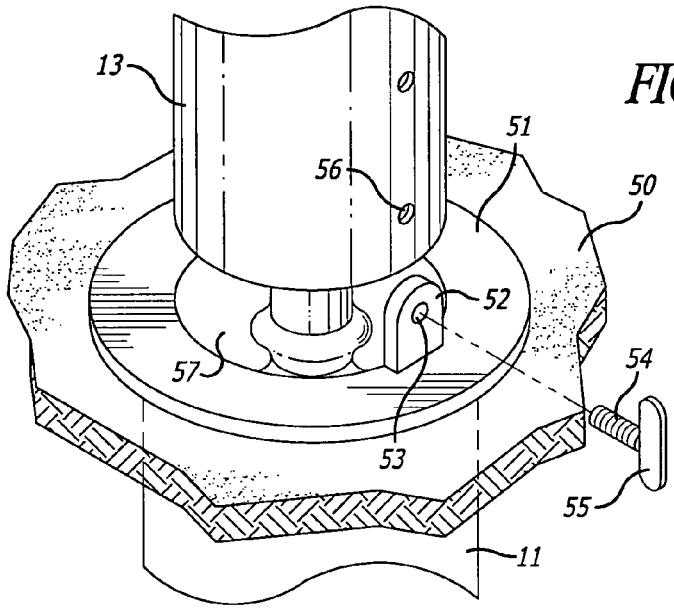
FIG. 3 is a perspective view illustrating adjustable mounting for the height adjustable riser shown in FIG. 2.
Figure 4:
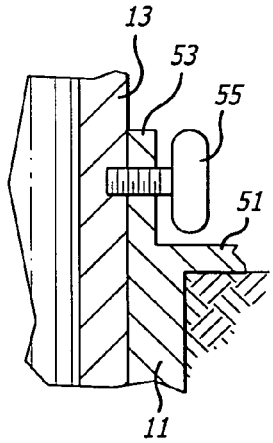
FIG. 4 is a fragmentary, cross-sectional view of the securement device used to retain the housing of the riser shown in FIG. 3 in releasable securement.

Referring to FIGS. 3 and 4, securement means are shown for retaining the adjustable riser 12 in a fixed position. The housing 11 is shown buried beneath the surface of the ground, which is indicated by numeral 50, and the housing 11 includes flange 51 which is on top of surface 50. The flange 51 includes a lug that further includes a threaded bore 53 for receiving a threaded shank 54 is threaded into a selected aperture, such as aperture 56, carried on the sidewall of adjustable riser 12. The adjustable riser 12 may move within the bore of the housing 11 as represented by numeral 57.

Figure 5:
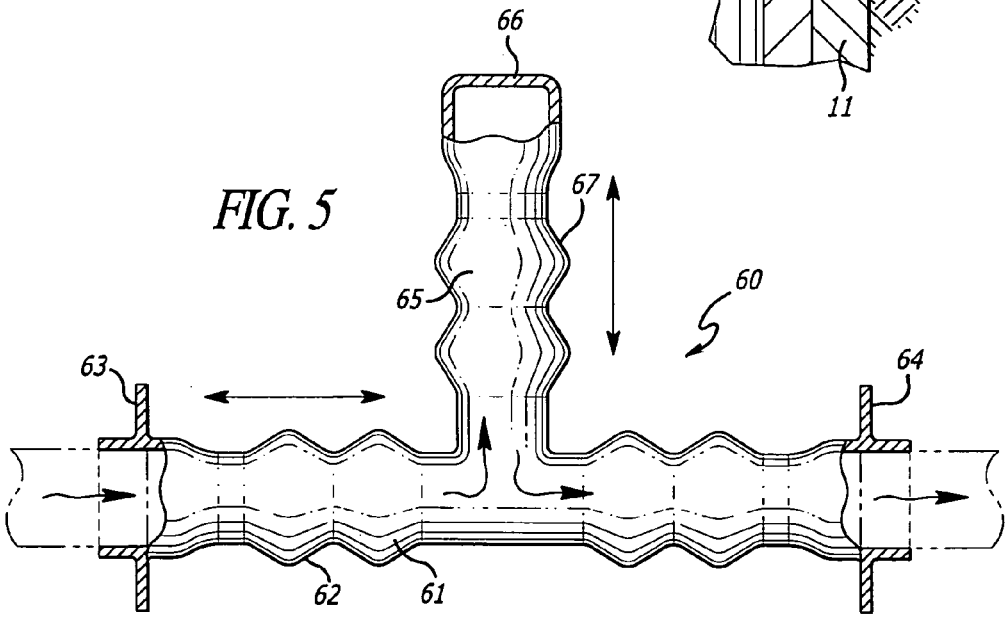
FIG. 5 is a side elevational view of a compressible/expandable water supply conduit which may or may not include a "T" section.

In FIG. 5, it can be seen that a mainline conduit is indicated in the direction of arrow 60 which may or may not be a T-shape. As illustrated, the main conduit is indicated by numeral 61 and includes a plurality of convolutions, such as convolution 62, which may be extendable or expanded to lengthen the distance between the opposite ends of the conduit 61. Therefore, the sidewall is flexible and the opposite ends of the conduit terminate in flanges 63 and 64. When the T-shaped conduit is employed, the expandable section 65 will absorb any pressure surges in the conduit 61. Pressurized fluid, such as water, will enter the section 65 to expand. Expansion is achieved since the sidewall of the section 65 is convoluted and a typical convolution is indicated by numeral 67. Upon reduction of pressure, the section 65 will retract into its original condition. Such a conduit may be coupled with the mainline water supply conduit 18 and the section 65, if used, may be oriented vertically or horizontally so that the conduit may be placed closed to the surface of the turf or ground.

Thus, it can be seen that the improved, adjustable riser of the present invention that includes the input water supply passageway 25 within the tubing 15 is an improvement because it will not only supply the pressurized fluid to the bottom of the housing 11, but permits the water supply line 18 as well as conduit 61 to be placed near the surface of the ground. This requires less digging and removal of earth in order to install a sprinkler system.

The cost and labor benefits resulting from this novel approach are self evident. A traditional installation delivering fluid vertically from a buried conduit requires trenching at a depth equal or greater than the depth of the sprinkler riser, e.g. 6" sprinkler/riser requires trenching, or removal and replacement, of at least 6 to 8 includes of soil. Similarly, a 4" sprinkler/rise requires removal and replacement of at least 4 to 6 includes of soil. By introducing the irrigation fluid into the side of the sprinkler housing, the depth of the conduit can be reduced to a depth necessary to place the conduit in the soil plus a small amount of soil used to cover the conduit. Locally at the site of the sprinkler installation a hole can be placed in the soil using common tools, such as shovel or post hole digger. Since the fluid enters all sprinkler/risers from the side rather than the bottom, a singe reduced depth trench can be used for multiple combinations of different height sprinkler/riser assemblies. This approach allows lawns and shrubbery to be easily and efficiently irrigated on the same circuit or station.

Due to surface proximity probability of damage to the conduits is increased. Also, an increased potential for expansion damage due to freezing exists; therefore, an expandable/compressible fitting is also provided which minimizes potential repairs due to damage caused either by maintenance crews or fluid solidification due to freezing.

Presently, repairs of the type noted above require removal of locally surrounding soil, installation of rigid clip-on kits or rigid bonded joints, and replacement of the soil. Both methods require substantial amounts of soil removal to expose, clean, and prepare for bonding, bon and allow the reinstalling of the new rigid components. The novel compressible/expandable fitting minimizes this task. Because the fitting can be compressed and placed between the ends of the conduit embedded in the soil, then allowed to expand over the end of the conduit, the removal of surrounding soil is minimized. Furthermore, reliability of completed repairs increases.

A slight modification of the compressible/expandable fitting, T-shaped rather than linear, provides expansion joints to minimize conduit damage in climates that experience periodic soil freezing.

While particular embodiments of the present invention have been shown and described, it will be obvious to those skilled in the art that change and modifications may be made without departing from this invention in is broader aspects and, therefore, the aim in the appended claims is to cover all such changes and modifications as fall within the true spirit and scope of this invention.

What is claimed is:

1. A height adjustable riser for a sprinkler comprising:

a housing embedded in the ground;

a riser secured to said housing adapted to project above the ground;

a resiliently biased tube movably mounted in said riser having a nozzle at one end thereof and an impact plate at its other end;

said tube normally biased inside said riser to conceal said nozzle and adapted to expose nozzle in response to water pressure against said impact plate;

means within said housing and secured to said riser for releasably holding said riser in a selected position on said housing for adjusting height of said nozzle above the ground;

a supply of pressurized water; and conduit means laterally and integrally mounted on said housing interconnecting said supply of pressurized water with said tube.

2. The height adjustable riser defined in claim 1 wherein:

said conduit means includes a water supply conduit formed in said housing and in parallel spaced-apart relationship with respect to said tube.

3. The height adjustable riser defined in claim 2 wherein:

said housing has a longitudinal vertical axis and said water supply conduit is in parallel, fixed spaced relationship to said vertical axis.

4. The height adjustable riser defined in claim 3 wherein:

said water supply conduit has an input end connected to said supply of pressurized water and an output end in fluid communication with said tube.

5. The height adjustable riser defined in claim 4 wherein:

said housing includes a top end supporting said riser and a bottom end integrally connected to said output end of said water supply conduit.

6. The height adjustable riser defined in claim 5 wherein:

said conduit means further includes a variable length pipe in said housing connecting said output end of said water supply conduit with said tube.

7. The height adjustable riser defined in claim 6 wherein:

said variable length pipe is composed of a plurality of convolutions for selectively adjusting for distance between said output end and said tube.

8. The height adjustable riser for a sprinkler defined in claim 7 wherein:

said means for releasably holding said riser includes a cartridge within said housing and attached to said riser for movement together as a unit;

said housing having a plurality of openings arranged in fixed, spaced-apart relationship; and resistantly mounted catches carried on said cartridge selectively engageable with said openings to maintain said riser at a selected height above the ground.

9. A height adjustable riser for a sprinkler comprising:

a cylindrical housing buried in the ground;

a riser movably supporting a sprinkler nozzle normally spring-biased within said riser;

a height adjustable cartridge secured to said sprinkler nozzle and movable therewith as a unit;

adjusting means cooperatively disposed between said cartridge and said housing for selectively locating said sprinkler nozzle above the ground;

said housing having a central longitudinal axis extending from a bottom end vertically to a top end;

a water supply conduit integrally provided with said housing in fixed parallel spaced-apart relationship with respect to said central longitudinal axis;

said water supply conduit having an outlet end connected to said bottom end of said housing; and a variable length pipe in said housing interconnected between said bottom end of said housing and said sprinkler nozzle.

10. The height adjustable riser defined in claim 9 including:

an outlet fluid conducting segment integral with said housing and having a horizontal central axis transverse to said central longitudinal axis.

11. The height adjustable riser defined in claim 10 wherein:

said water supply conduit, said variable length pipe and said outlet fluid conducting segment provide a continuous fluid passageway for conducting pressurized water external of said housing to said sprinkler nozzle.

12. The height adjustable riser defined in claim 11 including:

a source of pressurized water connected to said water supply conduit at an inlet end opposite to said outlet end; and a conduit segment laterally extending from said outlet end at a right angle with respect to said flexible and expandable hose.

13. The height adjustable riser defined in claim 12 wherein:

said water supply conduit buried in the ground and said inlet end being immediately adjacent to the ground surface.

14. The height adjustable riser defined in claim 13 including:

clamp means selectively securing said housing with said riser.

* * * * *